United States Patent [19]

Burrous et al.

[11] Patent Number: 5,018,307

[45] Date of Patent: May 28, 1991

[54] SELF-DRAINING THRESHOLD FOR AN OUT-SWINGING DOOR

[75] Inventors: Allen J. Burrous, Macedon; Silvio Colaprete, Rochester; David W. Kehrli, Lima, all of N.Y.

[73] Assignee: Schlegel Corporation, Rochester, N.Y.

[21] Appl. No.: 514,183

[22] Filed: Apr. 25, 1990

[51] Int. Cl.[5] ..... E06B 1/70

[52] U.S. Cl. ..... 49/471

[58] Field of Search ..... 49/471, 470, 469, 408, 49/467, 468, 476

[56] References Cited

U.S. PATENT DOCUMENTS

| | | | |
|---|---|---|---|
| 322,086 | 7/1885 | Bartholomew | 49/471 X |
| 586,467 | 7/1897 | Vogel | 49/471 |
| 1,768,730 | 7/1930 | Anderson | 49/476 X |
| 1,873,143 | 8/1932 | Olson et al. | 49/476 X |
| 2,010,609 | 8/1935 | Shogren | 49/470 |
| 2,129,381 | 9/1938 | Oftedal et al. | 49/471 |
| 2,202,482 | 5/1940 | Dahl | 49/476 |
| 2,570,336 | 10/1951 | Fouts | 49/471 X |
| 4,310,991 | 1/1982 | Seely | 49/470 |
| 4,513,536 | 4/1985 | Giguere | 49/470 |
| 4,686,793 | 8/1987 | Mills | 49/471 |
| 4,831,779 | 5/1989 | Kehrli et al. | 49/471 |

*Primary Examiner*—Philip C. Kannan

*Attorney, Agent, or Firm*—Cumpston & Shaw

[57] ABSTRACT

A self-draining hollow threshold for an out-swinging door of an enclosure, such as a room, is disclosed comprising an interior threshold portion extending into the enclosure, and having an upper wall. The interior threshold portion has a drainage system comprising a slot in the upper wall, for draining water that penetrates the plane of the door. Such water flows over the upper wall and through the hollow threshold to the exterior of the door and enclosure.

5 Claims, 2 Drawing Sheets

SELF-DRAINING THRESHOLD FOR AN OUT-SWINGING DOOR

FIELD OF THE INVENTION

The present invention relates generally to door thresholds, and more particularly to a self-draining threshold for an out-swinging door.

BACKGROUND OF THE INVENTION

Self-draining thresholds for inwardly opening doors are generally well known in the art, as exemplified by U.S. Pat. Nos. 322,086; 2,202,482; 4,310,991; 4,513,536; 4,686,793 and 4,831,779. One of the disadvantages of the self-draining door thresholds disclosed in these patents is that they are not applicable to out-swinging doors. Of these patents, only U.S. Pat. No. 2,202,482 has the capability of returning water that has penetrated the plane of the door, to the exterior of the door. This is achieved by a complicated weatherseal that is mounted to the bottom surface of the door.

Another disadvantage of these prior art door thresholds is that any water that penetrates the plane of the door frame and weatherseals during a rainstorm will flow over the threshold and on to the floor or carpet of the interior room.

SUMMARY OF THE INVENTION

The objects of this invention are achieved by providing a self-draining threshold for an out-swinging door leading into an enclosure comprising:

a hollow exterior threshold portion extending toward the outside of the door and enclosure;

a hollow interior threshold portion extending toward the inside of the door and enclosure and having an upper wall;

an elongate weatherseal;

means for mounting the weatherseal between the lower end of the door and the interior threshold portion; and drainage means in the threshold comprising a slot in the upper wall for draining water that penetrates the plane of the door and the weatherseals and flows over the upper wall, and through the hollow exterior threshold portion to the outside of the enclosure.

A more specific object of the present invention is to provide a self-draining threshold for an out-swinging door wherein the upper wall of the interior threshold portion comprises front and rear adjoining upper wall sections, wherein the weatherseal mounting means comprises an elongate recess in a shoulder of the interior threshold portion, wherein the slot of the drainage means extends through the upper wall at the junction of the front and rear adjoining upper wall sections, and wherein the drainage means further comprises a passage in the threshold for allowing the water entering the hollow threshold to flow. The front upper wall section of the threshold is further inclined downwardly toward the drainage slot and base.

BRIEF DESCRIPTION OF THE DRAWINGS

In the detailed description of the invention presented below, reference is made to the accompanying drawings, in which.

DETAILED DESCRIPTION OF THE INVENTION

Because door thresholds are well known, the present description will be directed in particular to elements forming part of, or cooperating directly with, a self-draining threshold for an out-swinging door in accordance with the present invention. It is to be understood that elements not specifically shown or described may take various forms well known to those skilled in the art.

Figure 1:
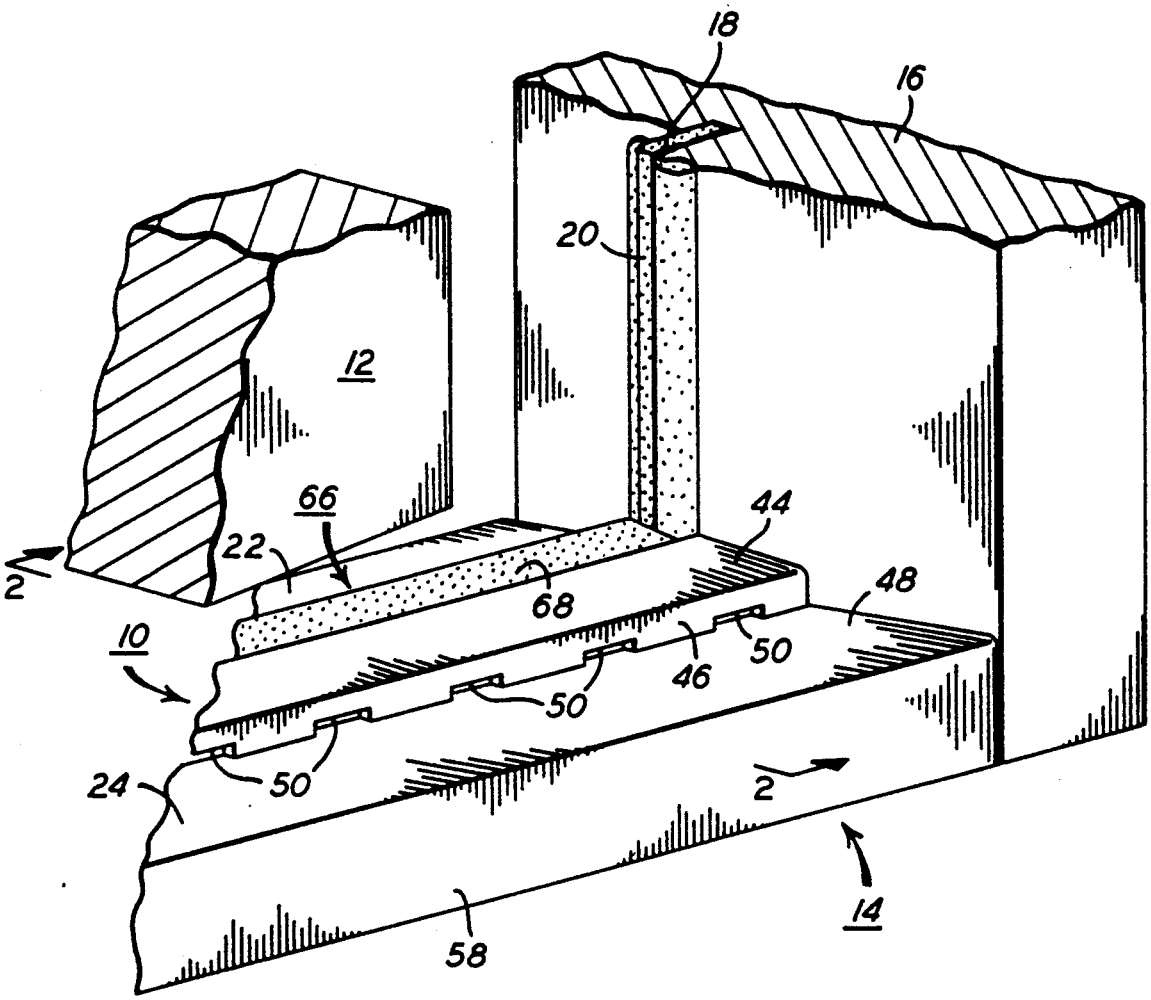
FIG. 1 is a segmental perspective view of a preferred of a self-draining threshold for an out-swinging door of this invention.

With reference to FIG. 1, a preferred embodiment of the self-draining door threshold 10 of the present invention is designed for use with an out-swinging door 12 leading into an enclosure, such as a room 14. The door 12 further includes a conventional door frame, shown only in part, within which the door is mounted. Such a door frame normally comprises a pair of upright jambs 16, of which only a part of one is shown, connected together at the top by a header, not shown, and further having the door threshold 10 of this invention at the bottom extending from one jamb 16 to the opposite jamb. The door frame can be made of wood, plastic, or metal, and is further provided with door stop strips or shoulders 18 to which conventional weatherseals 20 are secured by any suitable means. The door 12 and frame can preferably be assembled and installed as a unit at the building site, or can be constructed part-by-part at the building site.

The door threshold 10 of this invention may be manufactured from steel, wood, aluminum, or plastic, or combinations thereof, and may be extruded or injection molded or fabricated by any suitable process that lends itself to these materials. The door threshold 10 comprises an exterior threshold portion 22 extending toward the outside of the room, and an interior threshold portion 24 extending toward the inside of the room 14.

Figure 2:
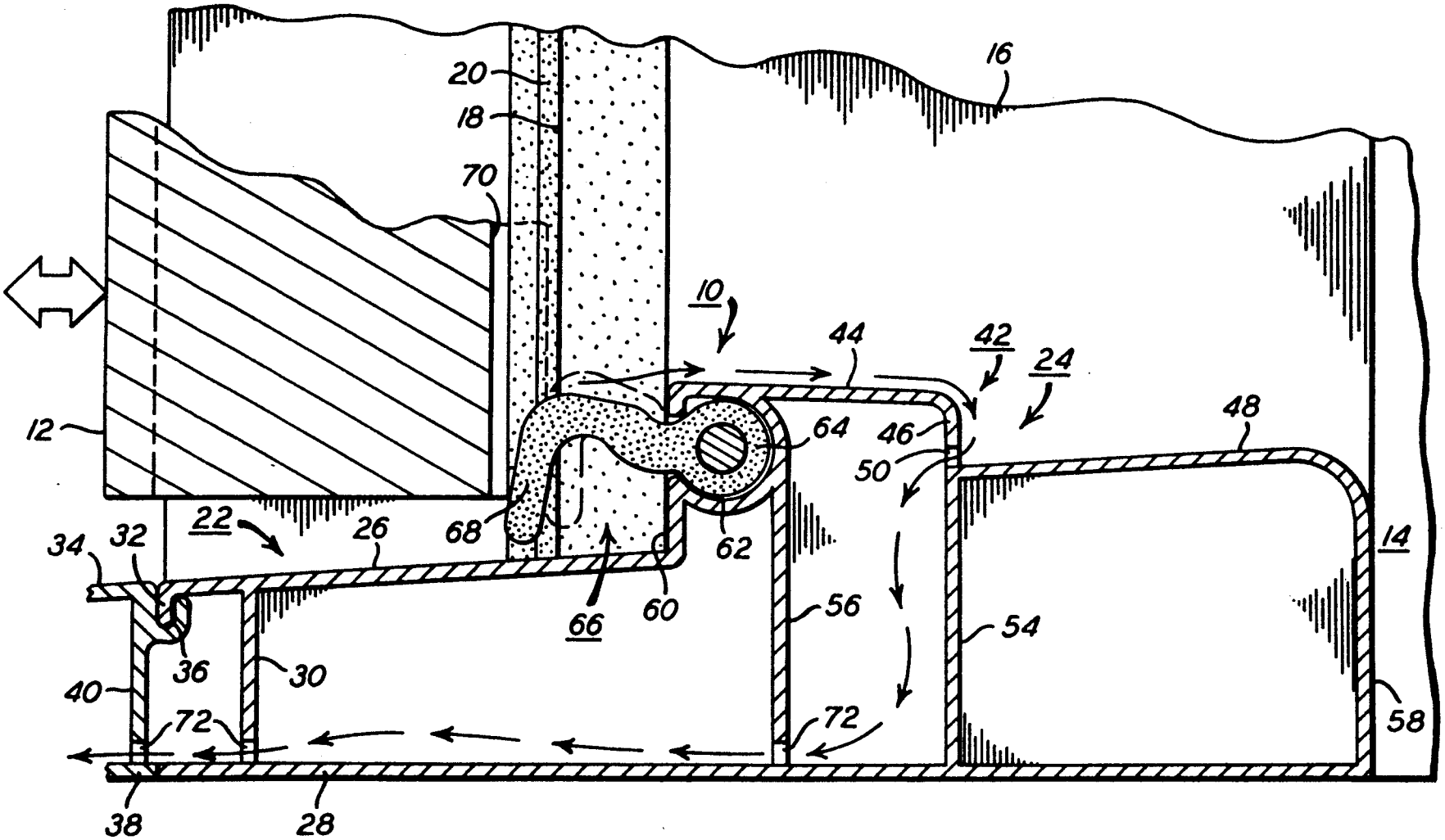
FIG. 2 is an enlarged section view taken substantially along line 2—2 of FIG. 1.

The exterior threshold portion 22, as illustrated in FIG. 2, comprises a downwardly inclined upper wall 26, a base wall 28, a strengthening partition 30 extending between the upper and base walls 26, 28 respectively, and an elongate lip 32 at one end of the upper wall 26. The exterior threshold portion 22 may further be provided with an extension, shown in part, comprising a downwardly inclined upper wall 34, having a blind recessed groove 36 at one end for receiving the elongated lip 32 with the upper surfaces of the upper walls 26,34 lying in one plane. The extension further has a base wall 38 that butts up against the end of base wall 28, and an end wall 40 connecting the upper and base walls 34, 38 respectively.

The interior threshold portion 24 has an upper wall 42 having a rear upper wall section 44 provided with a down-turned edge 46 at one end thereof. The upper wall 42 further has a front upper wall section 48 slightly below the rear upper wall section 44. The front upper wall section is inclined downwardly toward the rear upper wall section 44, and the front and rear upper wall sections 44, 48 respectively are provided with one or more drainage slots 50 at the junction of the edge 46 and one end 52 of the front upper wall section 48. The interior threshold portion 24 is further provided with a base wall integral with base wall 28, and strengthening partitions 54, 56 extending between the edge 46 and base wall 28, and between the rear upper wall section 44 and base wall 28. The front upper wall section 48 further has a toe plate 58 extending between the opposite end of the front upper wall section 48 and base wall 28 forming an end wall for the interior threshold portion. The interior threshold portion 24 further has a shoulder plate 60 connecting the opposite end of the upper rear wall section 44 to the upper wall 26 of the exterior threshold portion 22. The shoulder plate 60 is provided with an elongated blind recess 62 within which an enlarged cylindrical end 64 of an elongated weatherseal 66 is mounted. The opposite inverted V-shaped flexible sealing portion 68 of the weatherseal 66 is engagable by the inner surface 70 of the door 12, and is compressed into sealing engagement with the door when the door is moved to its closed position, as seen dotted in FIG. 2. The partitions 30, 56 in the threshold, and extension end wall 40 are all provided with passages 72 adjacent the base 28, to provide a part of the drainage system for draining water that penetrates the plane of the door 12 and weatherseal 20, 66 and leaks or flows over the rear upper wall section 44 into the hollow center of the door threshold 10.

During a severe storm, an out-swinging door 12 will be subjected to rains driven by high winds. Wind pressure may force water between the door surface and the weatherseal, even when the door is closed. In addition, when a person opens the out-swinging door, rain will strike exposed surfaces, such as the inside surface 70 of the door, any weatherseals 20, 66 that are mounted on the door and threshold, and the upper walls 42 of the threshold itself. Accordingly, when the door 12 is closed, the rain water will flow down the inner surface 70 of the door, along the weatherseals 20, 66, and over the upper wall 42 of the interior threshold portion 24 toward the floor and/or carpet of the ajoining room 14. However, with the improved drainage system of this invention, such water will flow through the drainage slots 50 in the rear upper wall section 44, into the hollow center of the threshold 10, and along the passages 72 to the outside of the threshold, as seen by arrows in the flow path denoted in FIG. 2.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A self-draining threshold for an out-swinging door leading into an enclosure comprising:

a hollow exterior threshold portion extending toward the exterior of the enclosure such that upon the opening and closing of the door, a portion of the door passes over the exterior threshold portion;

a hollow interior threshold portion extending away from the door into the interior of the enclosure and having an upper wall; and drainage means in the threshold comprising a slot in the upper wall of the interior threshold portion for draining water from the interior of the enclosure to the exterior of the enclosure, such that water which penetrates the plane of the door to the interior of the enclosure flows over the upper wall, into and through the slot and hollow threshold to the exterior thereof.

2. A self-draining threshold for an out-swinging door according to claim 1, and further comprising an elongate weatherseal, and means for mounting the weatherseal between the lower end of the door and the interior threshold portion.

3. A self-draining threshold for an out-swinging door according to claim 2, wherein the weatherseal mounting means comprises an elongate blind recess in the interior threshold portion for receiving the weatherseal, and the slot of the drainage means extends through the upper wall.

4. A self-draining threshold for an out-swinging door leading into an enclosure comprising:

a hollow exterior threshold portion extending toward the exterior of the enclosure;

a hollow interior threshold portion extending away from the door into the interior of the enclosure and having an upper wall;

drainage means in the threshold comprising a slot in the upper wall of the interior threshold portion for draining water that penetrates the plane of the door, such that the water flows over the upper wall, into and through the slot and hollow threshold to the exterior thereof;

an elongate weatherseal; and means for mounting the weatherseal between the lower end of the door and the interior threshold portion;

wherein the upper wall of the interior threshold portion comprises front and rear adjoining upper wall sections, wherein the weatherseal mounting means comprises an elongate recess on the interior threshold portion for receiving the weatherseal, wherein the slot of the drainage means extends through the upper wall substantially at the juncture of the front and rear upper wall sections, and wherein the drainage means further comprises a passage in the threshold portion, for allowing water entering the hollow threshold to flow out the exterior thereof.

5. A self-draining threshold for an out-swinging door leading into an enclosure comprising:

a hollow exterior threshold portion extending toward the exterior of the enclosure;

a hollow interior threshold portion extending away from the door into the interior of the enclosure and having an upper wall;

drainage means in the threshold comprising a slot in the upper wall of the interior threshold portion for draining water that penetrates the plane of the door, such that the water flows over the upper wall, into and through the slot and hollow threshold to the exterior thereof;

an elongate weatherseal; and means for mounting the weatherseal between the lower end of the door and the interior threshold portion;

wherein the upper wall of the interior threshold portion comprises front and rear adjoining upper wall sections, wherein the weatherseal mounting means comprises an elongate recess on the interior threshold portion for receiving the weatherseal, wherein the opening of the drainage means extends through the upper wall substantially at the juncture of the front and rear upper wall sections, and wherein the drainage means further comprises a passage in the threshold portion, for allowing water entering the hollow threshold to flow out the exterior thereof;

wherein the threshold has a base, wherein the rear upper wall section terminates in a shoulder facing the door, and the elongate recess is located in the shoulder, and wherein the upper wall section is inclined downwardly towards the drainage opening.

* * * * *